US007021382B2

(12) United States Patent
Angman et al.

(10) Patent No.: US 7,021,382 B2
(45) Date of Patent: Apr. 4, 2006

(54) DOWNHOLE AXIAL FORCE GENERATING TOOL

(75) Inventors: Per G. Angman, Calgary (CA); John Hughes, Calgary (CA)

(73) Assignee: Tesco Corporation, Calgary (CA)

( * ) Notice: Subject to any disclaimer, the term of this patent is extended or adjusted under 35 U.S.C. 154(b) by 43 days.

(21) Appl. No.: 10/473,202

(22) PCT Filed: Mar. 28, 2002

(86) PCT No.: PCT/CA02/00417

§ 371 (c)(1),
(2), (4) Date: Sep. 29, 2003

(87) PCT Pub. No.: WO02/079605

PCT Pub. Date: Oct. 10, 2002

(65) Prior Publication Data

US 2004/0089445 A1 May 13, 2004

Related U.S. Application Data

(60) Provisional application No. 60/279,412, filed on Mar. 29, 2001.

(51) Int. Cl.
*E21B 31/00* (2006.01)

(52) U.S. Cl. ..... 166/301; 166/98; 294/86.18; 294/86.23

(58) Field of Classification Search ..... 166/301, 166/98; 294/86.18, 86.23, 88
See application file for complete search history.

(56) References Cited

U.S. PATENT DOCUMENTS 2,377,249 A 5/1945 Lawrence
2,537,413 A * 1/1951 Lawrence ..... 166/98
2,595,014 A * 4/1952 Smith et al. ..... 166/98
2,806,534 A * 9/1957 Potts ..... 166/98
2,915,126 A * 12/1959 Potts ..... 166/98
2,984,302 A * 5/1961 Church et al. ..... 166/98
3,016,954 A * 1/1962 Crowell ..... 166/98
3,752,230 A * 8/1973 Bernat et al. ..... 166/98
4,311,195 A 1/1982 Mullins, II
4,407,364 A 10/1983 Johnston
5,040,598 A 8/1991 Pleasants
5,070,941 A 12/1991 Kilgore (Continued)

FOREIGN PATENT DOCUMENTS

GB 2 361 727 A 10/2001

(Continued)

*Primary Examiner*—William Neuder
(74) *Attorney, Agent, or Firm*—Bennett Jones LLP

(57) ABSTRACT

An axial force generating tool for applying a force on a structure positioned within a borehole is taught. The tool includes a housing (19) sized to fit within the borehole in which the tool is required to act; an outer seal (38) disposed about the housing and selected to create a seal between the housing and the borehole; an inner bore (32) through the housing including a seal to prevent flow from the inner bore out through the lower end; an opening (34) to the inner bore above the seal; a bracing means (36) for maintaining the housing against axial movement in the borehole once the housing is in a selected position within the borehole; a piston (27) mounted in sliding engagement wiht the housing for axial movement relative to the housing, the piston positioned to act between a pressure differential establishable between the inner bore and the borehole between the seal and the lower end to drive the piston axially relative to the housing; and a grapple connected to the piston for axial movement therewith.

21 Claims, 5 Drawing Sheets

U.S. PATENT DOCUMENTS 5,209,304 A * 5/1993 Nice ..... 166/383
5,228,507 A * 7/1993 Obrejanu et al. ..... 166/98
5,398,753 A 3/1995 Obrejanu et al.
5,673,754 A * 10/1997 Taylor, Jr. ..... 166/301
5,947,202 A 9/1999 Gazelwood
6,012,518 A 1/2000 Pringle et al.
6,095,583 A 8/2000 Beeman et al.

FOREIGN PATENT DOCUMENTS

WO WO 97/29270 8/1997
WO WO 01/84040 A1 8/2001

* cited by examiner

DOWNHOLE AXIAL FORCE GENERATING TOOL

CROSS REFERENCE TO RELATED APPLICATIONS

This application claims priority from U.S. Provisional Patent application Ser. No. 60/279,412 filed Mar. 29, 2001, by Angman et al., the specification of which is incorporated herein by reference.

FIELD OF THE INVENTION

This invention is directed to a tool for generating an axial pulling or pushing force in a downhole application and, in particular, to a downhole tool that is manipulated hydraulically to generate an axial pulling or pushing force downhole.

BACKGROUND OF THE INVENTION

In various downhole tools such as for example casing drilling lock assemblies, packers etc., a pushing force along the axis of the borehole is required to set the tool and a straight pull along the axis is necessary to release the tool from its engaged position inside the borehole. In particular, some downhole tools include locking dogs that are driven out to engage casing, tubing or the borehole wall by axial movement of one structure on the tool such as a mandrel, relative to another member on the tool such as a housing. These locking dogs are released from engagement with the casing, tubing or the borehole wall by reverse axial movement of the tool structures.

An axial force generating tool is used to generate axial movement by gripping and axially pulling or pushing one structure upward or downward relative to the other. It will be appreciated that while pulling and pushing motion is required to actuate downhole tools, similar motion is required in other downhole applications such as to unstick a structure, for example sanded-in tubing, which is hung up down hole.

Generally, an axial force generating tool must be lowered on tubing such as drill pipe or coiled tubing that has enough strength to accommodate the stresses to move the structure axially upward (towards surface) or downward. Wireline, although easier and more cost effective to run in, cannot withstand much pulling force and cannot be used to exert a pushing force. Therefore, wireline is not generally used with an axial force generating tool.

SUMMARY OF THE INVENTION

A tool has been invented that is operated hydraulically to apply a force directed axially upwardly or downwardly to a tool, i.e. "a straight pull" or "a straight push". Since hydraulics generate the axial force, a rigid tubing string need not be connected to the tool and the tool can be positioned downhole by gravity or pumping with or without connection to a wireline or a tubing string. The tool is useful in a borehole, a casing string, a tubing string etc., all of which are encompassed herein by the term borehole.

In accordance with one broad aspect of the invention there is provided an axial force generating tool comprising: a housing sized to fit within the borehole in which it is required to act, the housing having an upper end and a lower end; an outer seal disposed about the housing; an inner bore through the housing and sealable to prevent flow from the inner bore out through the lower end; an opening to the inner bore above the seal; a bracing means for maintaining the housing against axial movement in the borehole once the housing is in a selected position within the borehole; a piston mounted in sliding engagement with the housing for axial movement relative to the housing between a neutral position and a driven position; and a grapple connected for axial movement to the piston, the piston including a piston surface positioned below the seal and to be acted on by hydraulic pressure from within the inner bore to drive the piston axially relative to the upper end.

The tool is used to engage a downhole structure and apply an upward pulling or downward pushing force to it. The tool is inserted into the borehole and positioned above the structure on which an axial force is to be applied. The tool is inserted and positioned by any desired means. In one embodiment it is dropped into the hole and conveyed by gravity. In another embodiment the tool is run in by fluid pressure pumping. The tool can be free (not connected to any string) or attached to a wireline or tubing string, for example, of drill pipe or coiled tubing. Of course, it is advantageous to run the tool without the use of a rigid string such as coiled tubing or drill pipe, either in the free condition or attached to an easily insertable string such as wireline.

For actuation of the piston there must be a pressure differential established on either side of the piston surface. Thus, the pressure within the tool acting on the piston face must be greater that the pressure outside of the tool. To achieve this, the bore must be sealed against passage of fluids through the lower end of the housing and the outer seal must be set against the borehole wall to prevent fluid from moving therepast between the housing and the borehole wall.

The outer seal can be any seal suited to act between extreme pressure differentials and in well bore conditions. The seal can be, for example, a cup-type seal, compressible packer elements or V-seals selected to land on a polish bore formed in the borehole.

While the bore of the tool must be sealed during use of the tool for applying a pulling or pushing force and it is preferably open when returning the tool to surface to prevent swabbing of the wellbore. However, it can be open or closed during running of the tool, as desired. The method for running in the tool and the method for handling the tool after it has applied the pulling force will determine the assembly used for sealing the housing bore. In one embodiment the bore includes a plug in a seat, the plug being in sealing position against the seat during running in and axial force generation but is removable by releasable engagement dogs or by shearing out, by application of hydraulic pressure above a specific value. Thus, the plug can be removed when it is desired to return the tool to surface. In another embodiment, the bore contains a flapper valve that can be opened by fluid flow passing through the bore from the lower end to the upper end, but will seal against opposite fluid flow. In yet another embodiment, the bore has formed therein a seat for accepting a member which is dropped or conveyed downhole to seal against the seat once the tool is in position above the structure of interest and ready to be used to apply the pulling force. For example, a ball or a dart can be dropped from surface to seat in the housing, once the housing is in place.

The bracing means can be any means for preventing the tool from moving axially upwardly or downwardly in the borehole once it is in position. In one embodiment, the bracing means is an extension of the tool that butts against a part of the structure to be pulled (i.e. the housing about a mandrel). In another embodiment, the bracing means is a plurality of lock dogs that are driven or expanded out into engagement with the borehole wall. The lock dogs can be driven out by any means such as hydraulics or expanders.

The grapple can be selected from any of the devices for gripping a downhole structure, such as a spear, a collet, or a toothed member.

Shear screws or pins can be used to ensure that the piston and/or bracing means only operate above selected fluid pressures.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
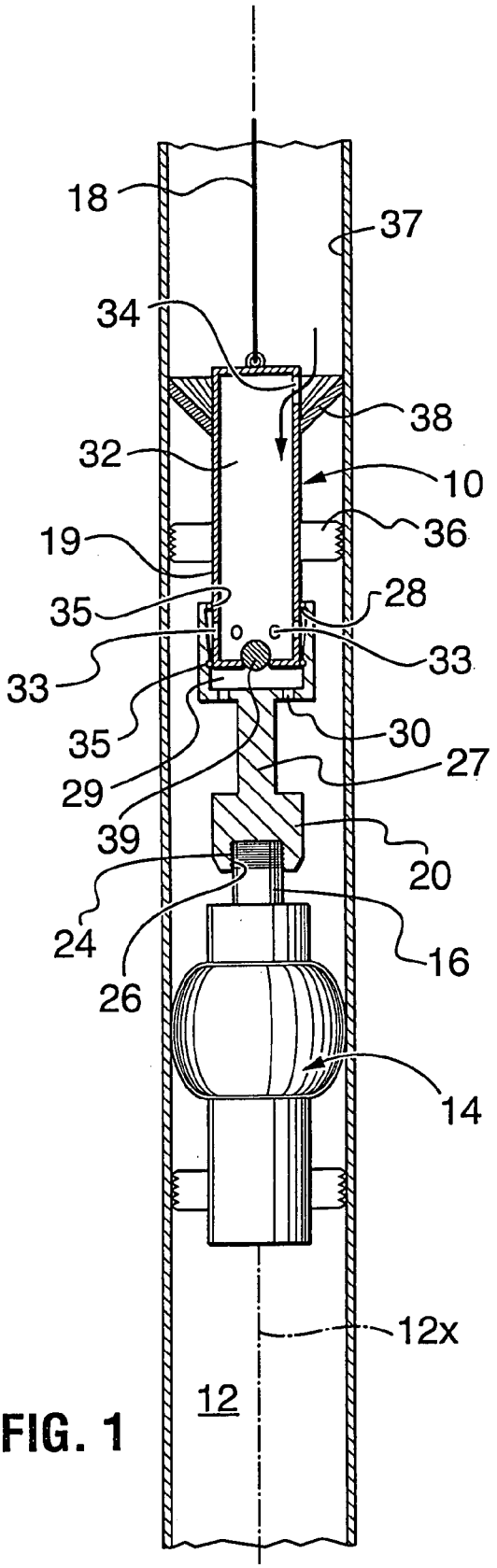
FIG. 1 is a vertical section, in somewhat schematic form, through a borehole with a hydraulic pulling tool according to the present invention positioned therein.

The drawing figures that follow are not necessarily to scale, and certain features are shown in generalized form to facilitate understanding.

Referring to FIG. 1, an embodiment of a tool 10 according to the present invention is shown. Tool 10 is positioned in a borehole 12. While the borehole is shown in vertical orientation, it is to be understood that tool 10 can also be operated in a horizontal or otherwise oriented borehole. The borehole includes an axis 12*x* and tool 10 includes an axis. The tool is axially aligned in the borehole and is formed to generate a force substantially along the axis.

Tool 10 is located above a packer 14 with a straight-pull release. In particular, tool 10 is gripping the packer's mandrel 16 in preparation for applying an upward pulling force thereon.

The tool is connected to a wireline 18 for tripping it to surface after it has operated to release the packer. The packer can remain attached to the tool and be tripped to surface with it.

The tool includes a housing 19 and a gripping means 20 including a plurality of teeth 24 that engage teeth 26 on the packer mandrel. The gripping means is attached to a piston rod 27 and a piston face 28. The piston rides along tool housing 19 as limited by the depth of chamber 29 between the housing and the piston. Apertures 30 in piston rod 27 permit pressure to be equalized between the chamber and the borehole below the tool such that a pressure lock does not occur.

Piston face 28 is in communication with an inner bore 32 of the housing via apertures 33 through the housing. Inner bore 32 and piston face 28 are in communication with the borehole above the tool via opening 34. The piston is a reverse piston such that fluid pressure applied in one direction, downwardly from surface, causes piston power stroke in the opposite direction toward surface. Seals 35 act between the piston and housing 19 to contain fluid pressure within the tool.

Dies 36 extend outwardly from housing and engage wall 37 of the borehole to brace the tool against axial movement in the borehole. The dies only bite into the wall of the borehole during operation of the piston and do not hinder running in or tripping out of the tool.

A seal 38 is disposed about the outer surface of housing 19. When energized, seal 38 seats against borehole wall 37 preventing passage of fluid between the housing and the borehole wall. A valve 39 seals in a valve seat in the housing to prevent passage of fluids from the inner bore out through the bottom of the housing.

Thus, when pump pressure is applied from surface a pressure differential is established above and below seal 38. Fluid at pump pressure enters inner bore 32, as shown by the arrows and passes through apertures 33 to act against piston face 28. Thus a pressure differential is also established on either side of piston face 28. The pressure differential at piston face 28 drives the piston upwardly to stroke rod 27 and gripping means 20 upwardly. This generates a pulling force on the mandrel which is also pulled upwardly to release the packer from engagement with the borehole.

Figure 2:
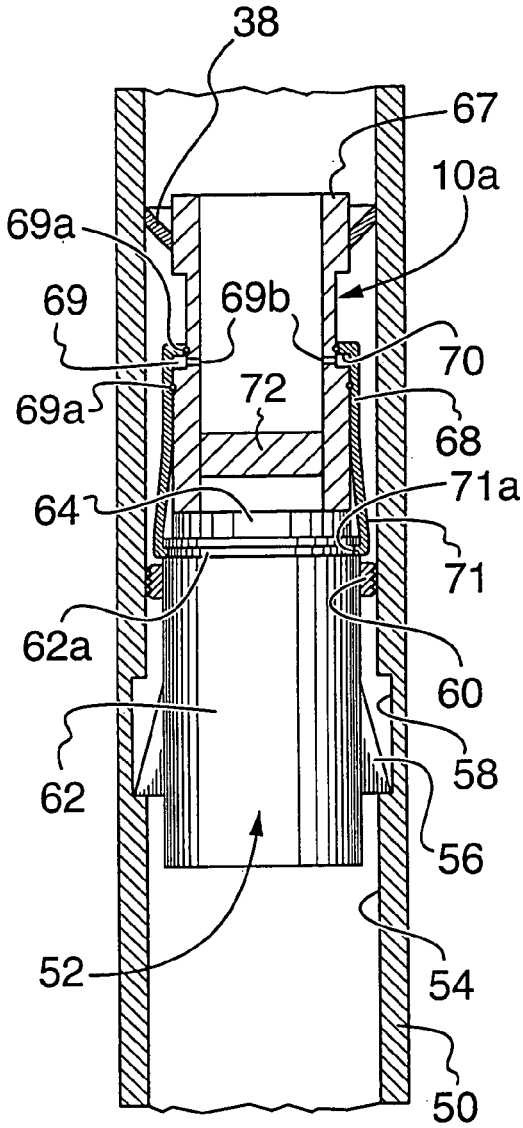
FIG. 2 is a vertical section, in somewhat schematic form, through a borehole with another hydraulic pulling tool according to the present invention positioned therein.

Another tool 10*a* is shown schematically in FIG. 2. Tool 10*a* is positioned in a string of casing 50 to release a drilling lock assembly 52 from engagement with the casing inner wall 54. In particular, drilling lock assembly 52 is engaged to the casing string for casing drilling and includes locking dogs 56 that lock into a profile 58 in the casing. This prevents the drilling lock assembly from moving downwardly in the borehole. The drilling lock assembly also includes dies 60 which engage against the casing wall. To release dies 60, housing 62 of drilling lock assembly must be pulled straight up over an inner mandrel 64.

Tool 10*a* includes a housing 67 and a piston 68, which therebetween define a piston chamber 69 sealed by seals 69*a*. Ports 69*b* provide communication between the bore of housing 67 and chamber 69. Piston 68 includes a piston face 70 and collet fingers 71 with collet lugs 71*a* thereon.

When tool 10*a* is in position above the drilling lock assembly, lugs 71*a* engage in a profile 62*a* on the housing and tool housing 67 abuts against the mandrel of drilling lock assembly 52. The abutment of the tool housing against the mandrel braces the tool from moving downwardly in the casing.

A cup seal 38 extends about the outer circumference of the housing to seal against passage of fluid downwardly therepast between tool 10*a* and casing inner wall 54. A plug 72 is disposed in the inner bore 67*x* of housing 67 to prevent passage of liquids through the lower end of the inner bore.

In use, tool 10*a* is introduced to the borehole and run in by pumping until it is positioned on drilling lock assembly 52 with the piston lugs engaged in the profile of drilling lock assembly housing 62. The fluid pressure above tool 10*a* is increased until the fluid pressure acting on piston face 70 is sufficient to draw housing 62 upwardly relative to the mandrel of the drilling lock assembly to release the drilling lock assembly from the casing.

When the drilling lock assembly is released from engagement with the casing, pressure can be increased such that plug 72 is blown out of sealing position within the inner bore of the tool and a spear can be lowered on wireline to trip the tool and drilling lock assembly back to surface.

Figure 3:
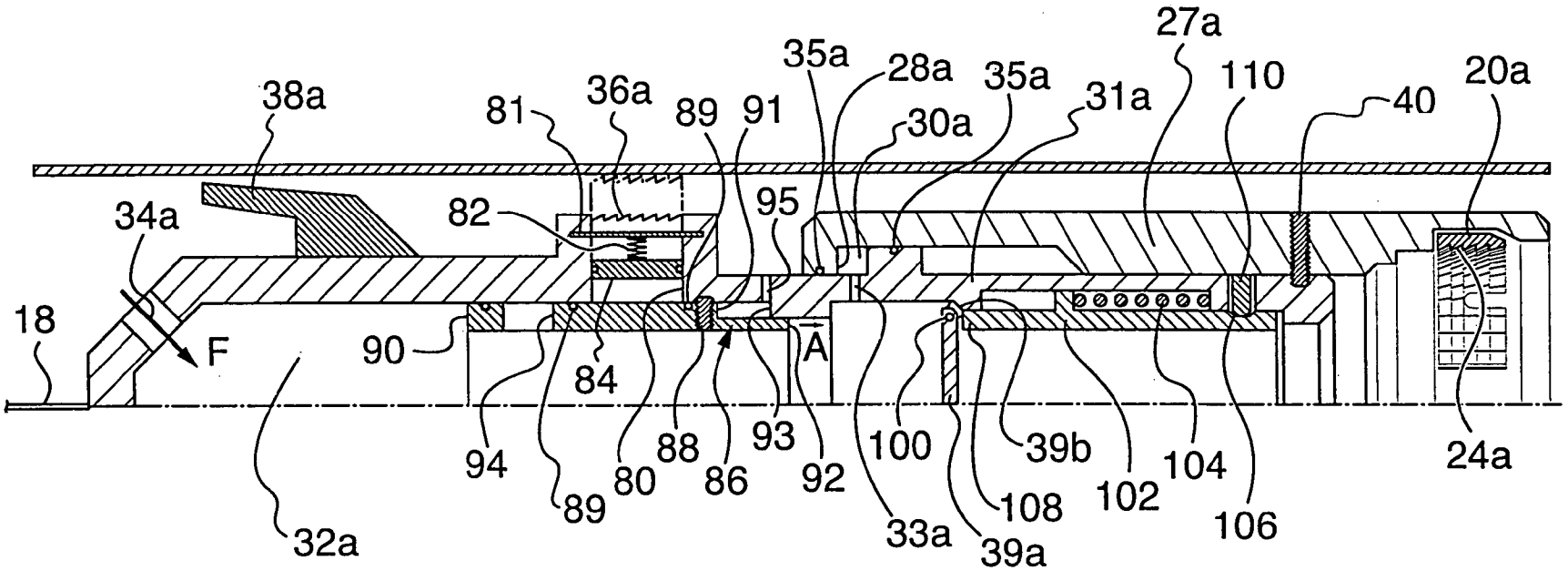
FIG. 3 is a sectional view of a hydraulic pulling tool according to one preferred embodiment of the present invention.

Referring to FIG. 3, another tool according to the present invention is shown. The tool is connected to a wireline 18 for tripping it to surface, but wireline 18 does not assist in the pulling operation.

The tool includes a grippers 20*a* including a plurality of teeth 24*a* selected to engage teeth on the structure to be pulled by the tool. The gripping means is attached to a piston having a rod 27*a* and piston face 28*a*. The piston rides along the outer surface of tool housing 31*a* forming a pressure chamber 30*a* therebetween as defined by seals 35*a*. Piston face 28*a* is in communication with an inner bore 32*a* of the housing via apertures 33*a* through the housing. Inner bore 32*a* and piston face 28*a* are in communication with the borehole above the tool via opening 34*a* at the upper end of the housing. The piston is a reverse piston such that fluid pressure applied in one direction causes piston power stroke in the opposite direction.

A shear screw 40 is secured between the piston and the housing to permit the piston to move only along the housing when the fluid pressure acting against face 28*a* reaches a selected pressure.

Dies 36*a* extend outwardly from housing 31*a* to engage the wall of the borehole in which the tool is positioned to brace the tool against axial movement in the borehole. Dies 36*a* are mounted in ports 80 in the housing and maintained in the ports by straps 81. Dies 36*a* are normally biased inwardly, as shown, by springs 82 but can be driven to extend outwardly, as shown in phantom, from housing by applying a force, such as hydraulic pressure, against the inner surface 84 thereof. Preferably, dies 36*a* are selected to be driven outwardly only when fluid pressure in the inner bore reaches a selected level. Thus, in one embodiment a sliding sleeve 86 is positioned in the inner bore to protect the inner surfaces 84 of the dies from being acted upon by fluid pressure until the fluid pressure reaches a selected level. Sleeve 86 includes an opening 94 therethrough that is alignable with port 80 by movement of the sleeve in the tool bore such that fluid pressure is communicated to the inner surfaces 84 of the dies to drive them outwardly and into engagement with the borehole wall. In particular, sliding sleeve 86 is, prior to use, secured in the inner bore by a shear screw 88 such that opening 94 is not aligned with port 80. Seals 89 are positioned between the sleeve and the housing to ensure that fluid cannot pass behind the sleeve. Sliding sleeve 86 includes an upper piston surface 90 and a lower piston surface 92. Upper piston surface 90 has a surface area greater than that of the lower piston surface such that fluid pressure will tend to move the sleeve along arrow A within the inner bore. Movement of sliding sleeve 86 is limited by abutment of shoulder 91 on the sleeve against shoulder 93 on the housing. Shoulder 91 is positioned relative to opening 94 and with consideration to the distance between port 80 and shoulder 93 such that when the shoulders abut, the opening in sleeve is aligned with the port. An aperture 95 prevents the formation of pressure lock behind the sleeve. Shear screw 88 is selected such that it is sheared when the fluid pressure acting against piston surface 90 exceeds a selected value.

The dies are preferably engaged against the borehole wall prior to the piston being driven to pull on the structure. Thus, preferably shear screw 88 is selected to be sheared at lower pressures than shear screw 40.

A cup-type seal 38*a* is disposed about the outer surface of housing 31*a*. When energized, seal 38*a* seats against borehole wall preventing passage of fluid therepast between the housing and the borehole wall. A flapper valve 39*a* seals against a valve seat 39*b* in the housing to prevent passage of fluids from the inner bore out through the bottom of the housing.

In use, the tool of FIG. 3 is run down hole by gravity or pumping until grippers 20*a* engage with the structure on which a pulling force is to be applied. Pump pressure is applied from surface to establish pressure differential above and below seal 38*a*. In so doing, fluid at pump pressure enters inner bore 32*a*, as shown by the arrow F, and passes through apertures 33*a* to act against piston face 28*a*. Fluid at pump pressure also acts against piston surface 90 on the sleeve. When the fluid reaches a pressure sufficient to shear screw 88, sleeve 86 will slide within bore 32*a* until opening 94 is positioned over port 80. Fluid pressure will then act to drive dies 36*a* outwardly, to the position shown in phantom, wherein they engage against the borehole wall.

Fluid pressure can then be increased from surface until the force applied to the piston through piston face 28*a* causes shear screw 40 to shear. The pressure differential on either side of piston face 28*a* causes the piston to be driven upwardly, thereby pulling at the structure to which the piston is secured by gripping means 20*a*.

Flapper valve 39*a* is normally free to pivot about a pivot pin 100 as dictated by fluid pressure differentials between the uphole and downhole sides of the valve. However, an opening sleeve 102 can be provided to drive the flapper to remain open after the tool has operated to pull on the downhole structure. In particular, opening sleeve 102 includes a compression spring 104, a profile 106 and a bearing end 108. A locking dog 110 is mounted in housing 31*a* and is driven by the piston into profile 106 to maintain spring 104 in compression. When the piston is moved upwardly it is removed from its position over locking dog 110, permitting the locking dog to move out of the profile. The sleeve will then be driven by spring 104 such that bearing end 108 drives flapper valve 39*a* to open and remain open as long as the fluid pressure acting thereagainst does not exceed the pressure in spring 104.

Figure 4:
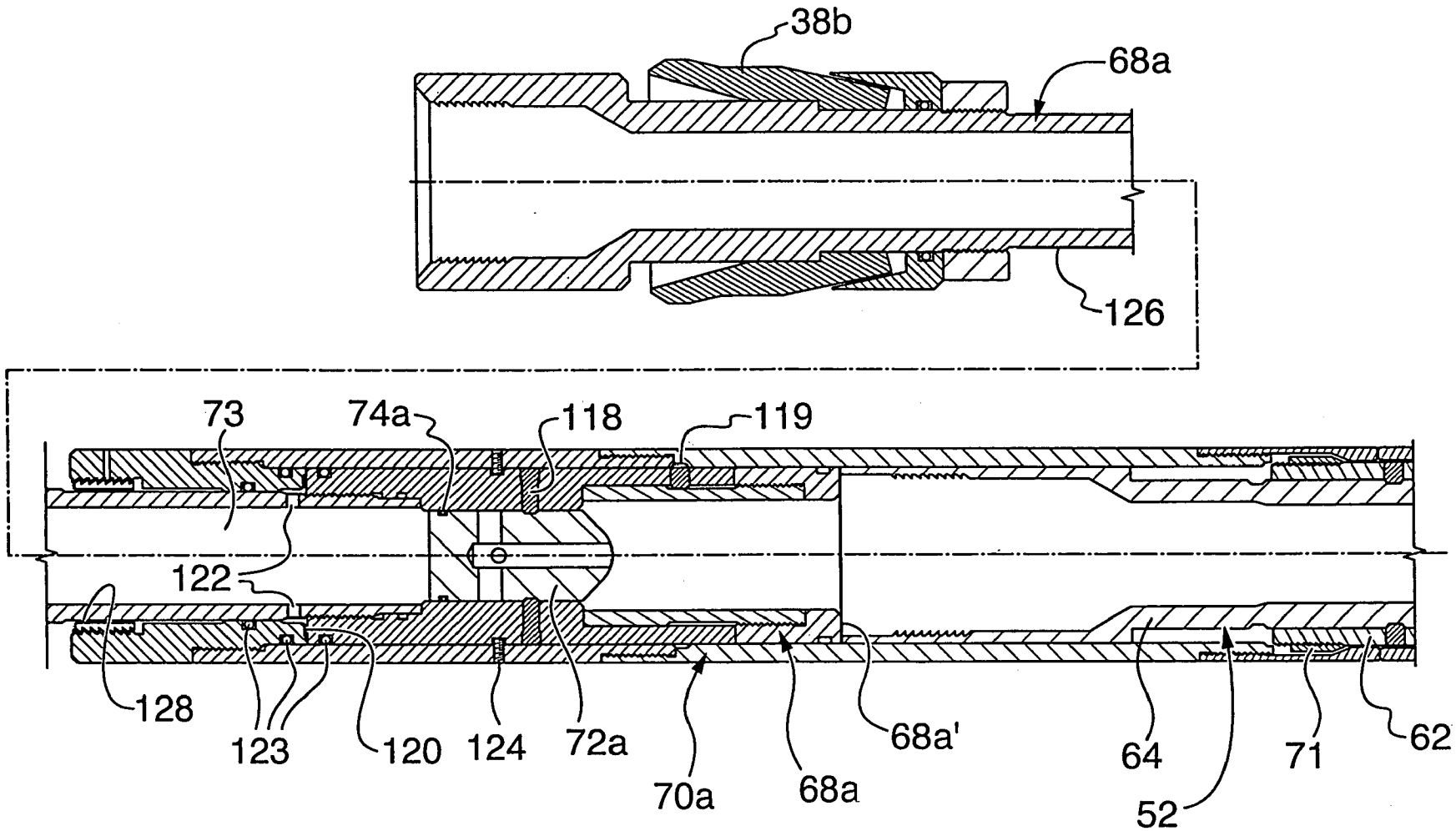
FIG. 4 is a sectional view of another hydraulic pulling tool according to the present invention.

Another tool is shown in detail in FIG. 4. The tool is shown attached to a drilling lock assembly (DLA) 52 including a housing 62 and an inner mandrel 64. The tool can be used to disengage the DLA from its engaged position within a casing string (not shown) by pulling housing 62 up relative to mandrel 64 to retract dies (not shown) on the DLA from engagement with the casing.

The tool includes a housing 68*a* and a piston 70*a*. When the tool is in position above the DLA, the grapple teeth 71 on piston 70*a* engage housing 62 and the lower end 68*a*' of tool housing 68*a* abuts against the upper end of DLA inner mandrel 64. Since DLA is engaged in position in the casing, the abutment of housing 68*a* with mandrel 64 braces the tool from moving downwardly in the casing.

Piston 70*a* includes a piston face 120 which is in communication with the inner bore 73 via ports 122 of the housing. Seals 123 prevent the hydraulic fluid from leaking between the housing and piston. Piston face 120 is acted on by fluid pressure from the inner bore to drive tool piston 70*a* and, thereby, the DLA housing 62 upwardly relative to the mandrel to release the drilling lock assembly from the casing. A shear screw 124 is secured between the piston 70*a* and the housing 68*a* to prevent the piston from sliding over the housing until the force generated by fluid pressure acting against face 120 reaches a sufficient level to shear the screw.

A cup seal 38*b* extends about the outer circumference of the housing to seal against passage of fluid downwardly therepast. A plug 72*a* is disposed in the inner bore 73 of housing 68*a* between the lower end 68*a*' and ports 122. The close fit between the housing and the plug and o-ring 74*a* prevent passage of liquids through the lower end of the inner bore. Plug 72*a* acts with cup seal 38*b* both in pumping the tool downhole and in the creation of a pressure differential above and below the tool. Thus, plug 72*a* is retained in the tool in such a way that it can withstand the fluid pressures encountered during pumping down and stroking the piston. However, it is generally necessary in order to trip the tool back to surface that the plug be removable to allow fluid flow through the bore. Thus, the plug is secured in the bore by means of dogs 118 that drop into a recess 119 and pull out of engagement with the plug once the piston is pulled up over the mandrel, allowing the plug to be driven out of the bore, by increasing fluid pressure above the tool.

When the drilling lock assembly is released from engagement with the casing, pressure can be increased such that plug 72*a* is blown out of sealing position within the inner bore of the tool and a spear (not shown) can be lowered on wireline to trip the tool and drilling lock assembly back to surface. Corresponding knurled portions 126, 128 are provided on housing 68*a* and piston 70*a*, respectively, to engage the piston in the upwardly driven configuration, even when the fluid pressure is released. This prevents piston 70*a* and DLA housing 62 from being pulled down by their weight over mandrel 64 to drive the dies on the DLA back out into engagement with the borehole (i.e. casing) wall.

Figure 5:
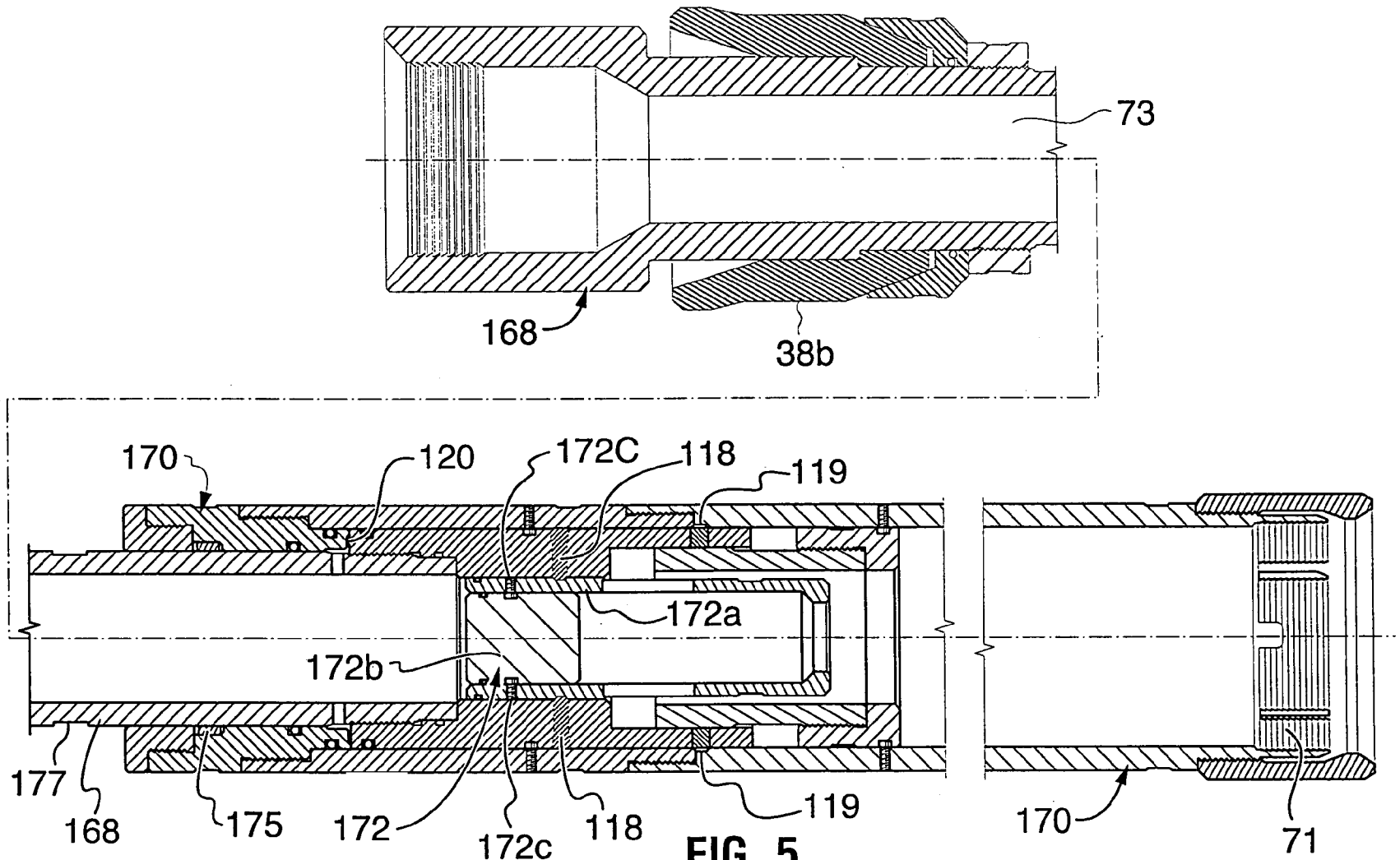
FIG. 5 is a sectional view of another hydraulic pulling tool according to the present invention.

Referring to FIG. 5, another pulling tool is shown. The pulling tool of FIG. 5 is similar to the tool of FIG. 4 in operation, except with respect to the plug and to means for engaging the piston in the upwardly driven configuration when the fluid pressure is released.

In particular, the illustrated tool includes a plug 172 including an outer sleeve 172*a* and an inner core 172*b* secured together by shear screws 172*c*. The plug is engaged in bore 73 using dogs 118 and can be released from the bore by retraction of the dogs once a pulling operation is complete. However, in the circumstance where it is desirable to open the bore without first stroking the tool, inner core 172*b* can be sheared out by application of pressures above the release rating of shear screws 172*c*.

The illustrated tool includes a snap ring 175 as the means for engaging the piston in the upwardly driven configuration when the fluid pressure is released. Snap ring 175 is carried on piston 170 and rides over the outer surface of housing 168 during a pulling operation until it lands in groove 177 on the housing. Groove 177 is positioned on the housing so that it will align with snap ring 175 at the upper stroke of the piston. Snap ring 175 engages between the housing and the piston to prevent the piston from dropping back down once it has been pulled up. A snap ring is used in this embodiment, while knurled portions were used in FIG. 4 and it is to be understood that other engaging means can be used.

Figure 6:
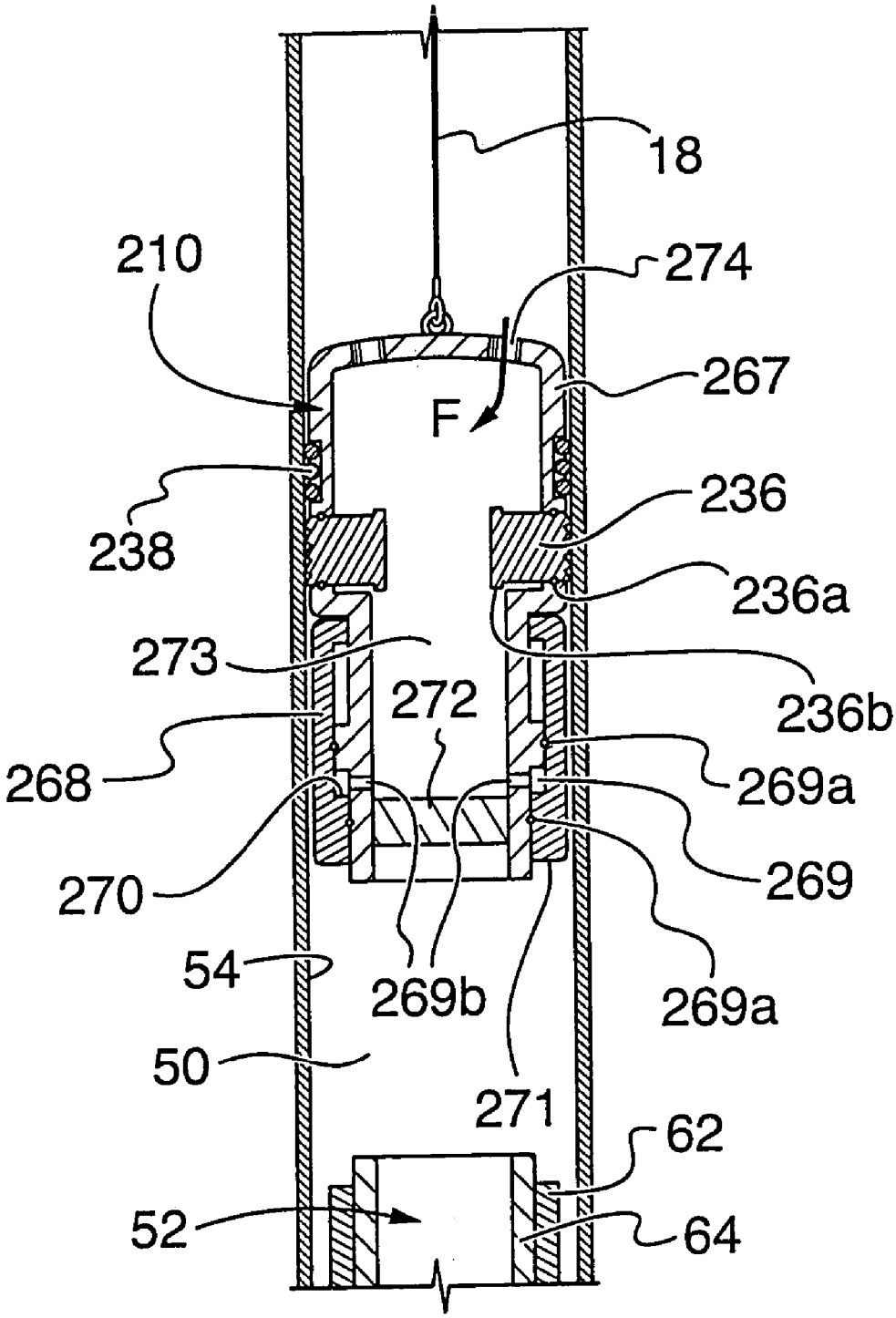
FIG. 6 is a vertical section, in somewhat schematic form, through a borehole with a hydraulic pushing tool according to the present invention positioned therein.

Another tool 210 is shown schematically in FIG. 6. Tool 210 is useful for applying a pushing force on a downhole structure.

Tool 210 is shown in a string of casing 50 approaching a drilling lock assembly 52. With reference to FIG. 2, the tool can be used to land on the drilling lock assembly and apply a downwardly directed force thereto to cause the dies 60 (FIG. 2) of the assembly to engage against the casing inner wall 54. In particular, to drive dies 60 into engagement with the casing, housing 62 of drilling lock assembly must be pushed straight down over inner mandrel 64.

The tool is connected to a wireline 18 for tripping it to surface after it has operated to set the packer.

Tool 210 includes a housing 267 and a piston 268, which therebetween define a piston chamber 269 sealed by seals 269*a*. Ports 269*b* provide communication between the bore 273 of housing 267 and chamber 269. Piston 268 includes a piston face 270 and a grapple 271.

A plurality of compressible packer elements 238 extend about the outer circumference of the tool housing to seal against passage of fluid downwardly therepast between tool 210 and casing inner wall 54. A plug 272 is disposed in the inner bore 273 between the bottom end of the housing and ports 269*b* to prevent passage of liquids through the lower end of the inner bore.

A plurality of dies 236 are carried in ports on the housing. Seals 236*a* are disposed between the dies and the ports. Dies 236 can be driven outwardly, as limited by returns 236*b*, by application of fluid pressure therebehind and when driven outwardly they engage against casing inner wall 54 of the borehole to brace the tool against axial movement in the borehole. The dies only bite into the wall of the borehole during application of a selected pressure therebehind and do not hinder running in or tripping out of the tool.

In use, tool 210 is introduced to the borehole and run in by pumping until tool 210 is in position above the drilling lock assembly with tool housing 267 abutting against the mandrel of drilling lock assembly 52. Fluid pressure in the casing above the tool is communicated into bore 273 above plug 272 through ports 274, as shown by arrows F.

Once the tool is in position, the fluid pressure above the tool is then increased until the fluid pressure acting against dies 236 is sufficient to drive them out into engagement with the casing. The fluid pressure is then further increased until the fluid pressure acting on piston face 270 is sufficient to push piston 268 down to abut against housing 62 and move it down relative to the mandrel of the drilling lock assembly to drive the dies of the drilling lock assembly out into engagement with the casing.

When the drilling lock assembly is released from engagement with the casing, pressure can be increased such that plug 272 is blown out of sealing position within the inner bore of the tool and wireline 18 can be pulled to trip the tool back to surface.

Although preferred embodiments of the present invention have been described in some detail hereinabove, those skilled in the art will recognise that various substitutions and modifications may be made to the invention without departing from the scope and spirit of the appended claims.

The invention claimed is:

1. A hydraulic axial force generating tool for applying a force on a structure positioned within a borehole, the hydraulic axial force generating tool comprising: a housing sized to fit within the borehole in which the tool is required to act, the housing having an upper end and a lower end; an outer seal disposed about the housing and selected to create a seal between the housing and the borehole; an inner bore through the housing and sealable to prevent flow from the inner bore out through the lower end; an opening to the inner bore above the seal; a bracing means for maintaining the housing against axial movement in the borehole once the housing is in a selected position within the borehole; a piston mounted in sliding engagement with the housing for axial movement relative to the housing between a neutral position and a driven position, the piston positioned to act in response to a pressure differential establishable across the seal to generate a first pressure in the inner bore and a second pressure in the borehole below the seal and in communication with the lower end to drive the piston axially relative to the housing from the neutral position to the driven position; and a grapple connected to the piston for axial movement therewith.

2. The hydraulic axial force generating tool of claim 1 capable of being conveyed through the borehole by pumping fluid therebehind.

3. The hydraulic axial force generating tool of claim 1 capable of being conveyed through the borehole by gravity.

4. The hydraulic axial force generating tool of claim 1 further comprising a removable plug in the inner bore.

5. The hydraulic axial force generating tool of claim 1 further comprising a check valve in the inner bore permitting flow through the inner bore from the lower end to the upper end.

6. The hydraulic axial force generating tool of claim 1 further comprising corresponding locking means between the piston and the housing, selected to lock the piston in the driven position.

7. The hydraulic axial force generating tool of claim 1 wherein the bracing means includes dies driveable out from the housing.

8. A hydraulic axial force generating tool for applying a force on a structure positioned within a borehole, the hydraulic axial force generating tool comprising: a housing sized to fit within the borehole in which the tool is required to act, the housing having an outer surface, an upper end and a lower end; an outer seal disposed about the housing and selected to create a seal between the housing and the borehole; an inner bore through the housing and sealable to prevent flow from the inner bore out through the lower end; a brace for maintaining the housing against axial movement in the borehole once the housing is in a selected position within the borehole; a piston mounted in sliding engagement with the housing for axial movement relative to the housing between a neutral position and a driven position, the piston positioned to act in response to a pressure differential across the seal to drive the piston axially relative to the housing from the neutral position to the driven position; an opening through the housing from the outer surface to the inner bore, the opening being positioned between the upper end and the seal and being open to permit fluid communication from the outer surface to the inner bore when the piston is in the neutral position; and a grapple connected to the piston for axial movement therewith.

9. The hydraulic axial force generating tool of claim 8 capable of being conveyed through the borehole by pumping fluid therebehind.

10. The hydraulic axial force generating tool of claim 8 capable of being conveyed through the borehole by gravity.

11. The hydraulic axial force generating tool of claim 8 further comprising a removable plug in the inner bore.

12. The hydraulic axial force generating tool of claim 8 further comprising a check valve in the inner bore permitting flow through the inner bore from the lower end to the upper end.

13. The hydraulic axial force generating tool of claim 8 wherein the brace includes dies driveable out from the housing.

14. The hydraulic axial force generating tool of claim 8 further comprising corresponding locks between the piston and the housing, selected to lock the piston in the driven position.

15. A hydraulic axial force generating tool for applying a force on a structure positioned within a borehole, the hydraulic axial force generating tool comprising: a housing sized to fit within the borehole in which the tool is required to act, the housing having an upper end and a lower end; an outer seal disposed about the housing and selected to create a seal between the housing and the borehole; an inner bore through the housing and sealable to prevent flow from the inner bore out through the lower end: an opening to the inner bore above the seal; a brace for maintaining the housing against axial movement in the borehole once the housing is in a selected position within the borehole; a piston including a piston face, the piston mounted in sliding engagement with the housing for axial movement relative to the housing between a neutral position and a driven position in response to application of fluid pressure against the piston face, the fluid pressure communicated to the piston face through the opening and through the inner bore from the borehole about the tool; and a grapple connected to the piston for axial movement therewith.

16. The hydraulic axial force generating tool of claim 15 capable of being conveyed through the borehole by pumping fluid therebehind.

17. The hydraulic axial force generating tool of claim 15 capable of being conveyed through the borehole by gravity.

18. The hydraulic axial force generating tool of claim 15 further comprising a removable plug in the inner bore.

19. The hydraulic axial force generating tool of claim 15 further comprising a check valve in the inner bore permitting flow through the inner bore from the lower end to the upper end.

20. The hydraulic axial force generating tool of claim 15 wherein the brace includes dies driveable out from the housing.

21. The hydraulic axial force generating tool of claim 15 further comprising corresponding locks between the piston and the housing, selected to lock the piston in the driven position.

* * * * *